United States Patent [19]

Dice, Jr. et al.

[11] 4,018,143

[45] Apr. 19, 1977

[54] CARDBOARD BOX ERECTING MACHINE

[75] Inventors: S. Virgil Dice, Jr., Rowland Heights; Harry R. Lobdell, Rolling Hills Estate, both of Calif.

[73] Assignee: Cal Crown Corporation, Los Angeles, Calif.

[22] Filed: May 2, 1975

[21] Appl. No.: 573,895

[52] U.S. Cl. ..... 93/36.3; 53/186; 93/53 SD

[51] Int. Cl.[2] ..... B31B 5/02; B31B 5/60; B31B 1/80

[58] Field of Search ..... 93/36.3, 53 SD, 53 R, 93/39 R; 53/183, 381 R, 186

[56] References Cited

UNITED STATES PATENTS

| | | | |
|---|---|---|---|
| 3,323,283 | 6/1967 | Johnson, Jr. et al. | 93/53 SD |
| 3,397,624 | 8/1968 | Currie, Jr. et al. | 93/53 SD X |
| 3,477,349 | 11/1969 | Berney | 93/36.3 X |
| 3,537,361 | 11/1970 | Derderian | 93/53 R |
| 3,665,674 | 5/1972 | Bivans et al. | 53/186 X |
| 3,739,696 | 6/1973 | Pearson | 93/53 R X |
| 3,753,333 | 8/1973 | Derderian et al. | 53/381 R X |
| 3,911,799 | 10/1975 | Klund | 93/53 SD X |
| R27,631 | 5/1973 | Berney | 93/53 SD X |

*Primary Examiner*—Othell M. Simpson
*Assistant Examiner*—Horace M. Culver
*Attorney, Agent, or Firm*—Blakely, Sokoloff, Taylor & Zafman

[57] ABSTRACT

An improved cardboard box erecting machine for receiving stacks of folded cardboard boxes, and for opening the boxes and folding and/or securing the bottom flaps thereof.

The various steps in erecting the cardboard box are each accomplished at a plurality of individual stations in the automatic erector, thereby allowing maximum throughput by minimizing the operations at any station prior to movement of the box to the next station. The erector includes numerous adjustments, including an adjustment in the longitudinal position of the lateral flap folding mechanism to provide the desired operation thereof regardless of the size of boxes being erected.

2 Claims, 17 Drawing Figures

26
51a
106
100
106
26
108
30a 130
128
132
30b
51b
122
120
120
30b 132
130
51b
128
30b
150
120
122
30b
148
174
140

132
130
150
128
51b
30b
148
30b
174
140

220
51c
30c
220
210
30c
212
210
148
174
140

224
30d
51d
30d

CARDBOARD BOX ERECTING MACHINE

BAGKGROUND OF THE INVENTION

1. Field of the Invention

The present invention relates to the field of container fabrication equipment, and particularly cardboard box erector equipment.

2. Prior Art

Cardboard boxes are commonly used by manufacturers for the packaging and shipment of manufactured goods, processed food items, and the like. The boxes are received by the manufacturers in a folded condition and must be unfolded and the bottoms thereof closed prior to being filled with the manufacturer's product for shipment. In the smaller plants, or for very small, specialized items, this may be a hand operation, though in a larger automated plant, the automated equipment will include some apparatus for receiving the boxes in the folded condition, and unfolding, closing and sealing the bottom thereof for delivery to filling machines.

One type of prior art box erector sequentially receives a folded box from a magazine, opens the box and folds the lateral flaps before passing the box onward for applying adhesive to the longitudinal flaps and final folding and pressing of the flaps for good adhesion. This machine is a relatively compact machine and has certain adjustments provided so as to allow the erection of boxes of reasonable variation in size. However, it is limited in speed because of the number of operations performed at the first station. In particular, these operations include (1) the sequential separation of each folded box from the stack of folded boxes in the magazine, (2) the opening of the box into a rectangular form, and (3) the folding of the lateral flaps, and finally, the passage of the box past the adhesive applying station.

All of the foregoing operations were necessarily sequential, as the lateral flaps could not be folded before the box was opened to the basic box form, which in turn could not be done until the box was separated from the other boxes in the magazine. Accordingly, instead of the erection time for each box being limited to the slowest operation, the erection time is actually limited to the sum of the cycle times for a number of major operations in the box erection.

BRIEF SUMMARY OF THE INVENTION

An improved cardboard box erecting machine for receiving stacks of folded cardboard boxes, and for opening the boxes and folding and/or securing the bottom flaps thereof.

The major steps in erecting a box which are accomplished by the present invention are sequentially separating one folded box from a stack thereof, opening the box, folding the bottom lateral flaps thereof, applying an adhesive to the longitudinal bottom flaps, folding the bottom longitudinal flaps to the closed position, and pressing the lateral and longitudinal flaps together to assure proper contact of the adhesive. In the present invention, these various steps in erecting the cardboard box are accomplished at a plurality of individual stations in the automatic erector, thereby allowing maximum throughput by minimizing the operation at any station prior to movement of the box to the next station. The erector includes numerous adjustments, including an adjustment in the longitudinal position of the lateral flap folding mechanism to provide the desired operation thereof regardless of the size of boxes being erected.

DETAILED DESCRIPTION OF THE INVENTION

Figures 1, 1A, 1B:
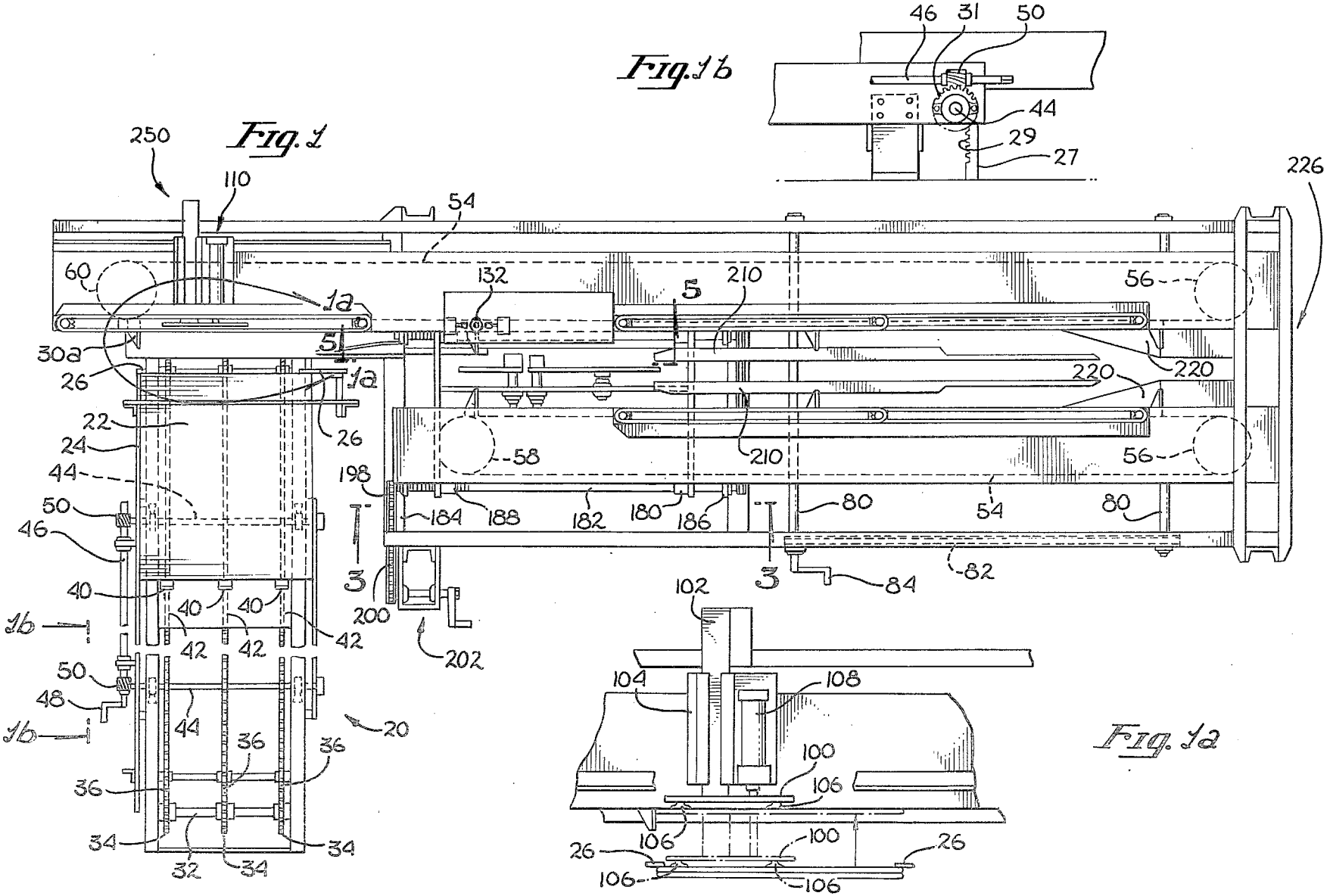
FIG. 1 is a top view of the preferred embodiment of the present invention.
FIG. 1*a* is a view taken on an expanded scale along line 1*a*—1*a* of FIG. 1 showing some of the details of the pull-out station.
FIG. 1*b* is a side view of the adjustment mechanism on the magazine to adjust the height thereof.

First, referring to FIG. 1, a top view of the preferred embodiment of the present invention may be seen. For convenience, the various stations of the erector are identified adjacent to the respective portions of the machine. Thus, the machine has as its basic input a magazine which, in the preferred embodiment, may hold three hundred folded boxes. The boxes are individually and sequentially separated from the stack of boxes in the magazine at the pull out station for individual conveying to the next station where they are opened and the bottom lateral flaps are folded. The boxes then progress past a station which applies adhesive to the flaps, in particular by applying hot melt adhesive at a fixed location onto the inside surface of the longitudinal flaps as the box passes. The box then progresses into a wedge shaped area which encourages the longitudinal flaps into the folded position, with the adhesive coated surfaces thereof in facing disposition with the lateral flaps.

Finally, at the press station, a pressure plate is directed into the box from above to press the lateral and longitudinal flaps into firm, face to face abutment to assure effective adhesion therebetween.

The magazine 20 (FIG. 1) used with the preferred embodiment of the present invention is designed to hold a plurality of cases 22 against a side reference plate 24, and to encourage the stack of boxes 22 toward the pullout station. The magazine contains stops 26 which stop the progress of the stack of boxes just short of the pullout station to provide sufficient clearance for a plurality of dogs 30 on a continuous chain 54 to pass thereby. The magazine is provided with a shaft 32 at each end thereof, with sprockets 34 supporting the support and drive chains 36 encircling the respective sprockets 34 at each end of the magazine. Between any two sprockets supporting one of the drive chains is a slide plate having substantially the same thickness as the sprockets themselves and being coplanar therewith so as to maintain the drive chain straight and to provide continuous support for the respective chain at the desired elevation under the load of the stack of boxes thereon. These plates maintain the drive chains slightly above the frame of the magazine structure so that the cases may freely rest thereon and advance with the drive chain without frictional engagement with any other structure, (other than perhaps an insubstantial drag on the reference plate 24 adjacent the edge thereof).

Attached to the drive chains 36 at one location is a plate 38 supporting upright members 40 retaining the end of the stack of boxes 22, with the uprights 40 being reinforced by reinforcing webs 42. The entire drive chain assembly is driven by a vacuum operated piston cylinder assembly which drives a lever mounted to a clutch on one of the shafts supporting a set of the chain sprockets 34. A pair of mechanically actuated valves are positioned adjacent the lever and the clutch for automatic control of the piston cylinder assembly. In particular, as the piston cylinder assembly approaches one extreme of its stroke, a valve is actuated causing the cylinder to go to the other extreme of its stroke, actuating the second valve to again retract the piston, thereby taking a new "bite" on the shaft to encourage the shaft into continuous rotation with a torque determined by the air and the piston cylinder assembly size.

Also, it should be noted that the level at which the erected boxes are delivered at the outlet of the machine is substantially fixed. Accordingly, since the boxes standing in the magazine are standing, not on the bottom of the box, but on the bottom edge of the flap which will be folded upward to form the bottom of the box, the desired level of the magazine will vary with respect to the rest of the erector depending on the size of the boxes being erected (e.g., more particularly, the length of the flaps on the boxes being erected). Thus, as shown in FIGS. 1 and 1*b*, the magazine stands on four legs 27, each of which in part forms a rack 29 driven by a cooperatively disposed pinion gear on shafts 44 supported on the frame of the magazine. A longitudinal shaft 46 which may be manually driven by a crank 48 has worm gears 50 thereon driving larger gears 31 on the shafts 44 supporting the rack drive pinion, thereby forming an easily adjustable, self locking vertical height adjustment system. Also supported on this system are bottom support rails 39 (see FIG. 6) which support the box until erection begins.

Figure 2:
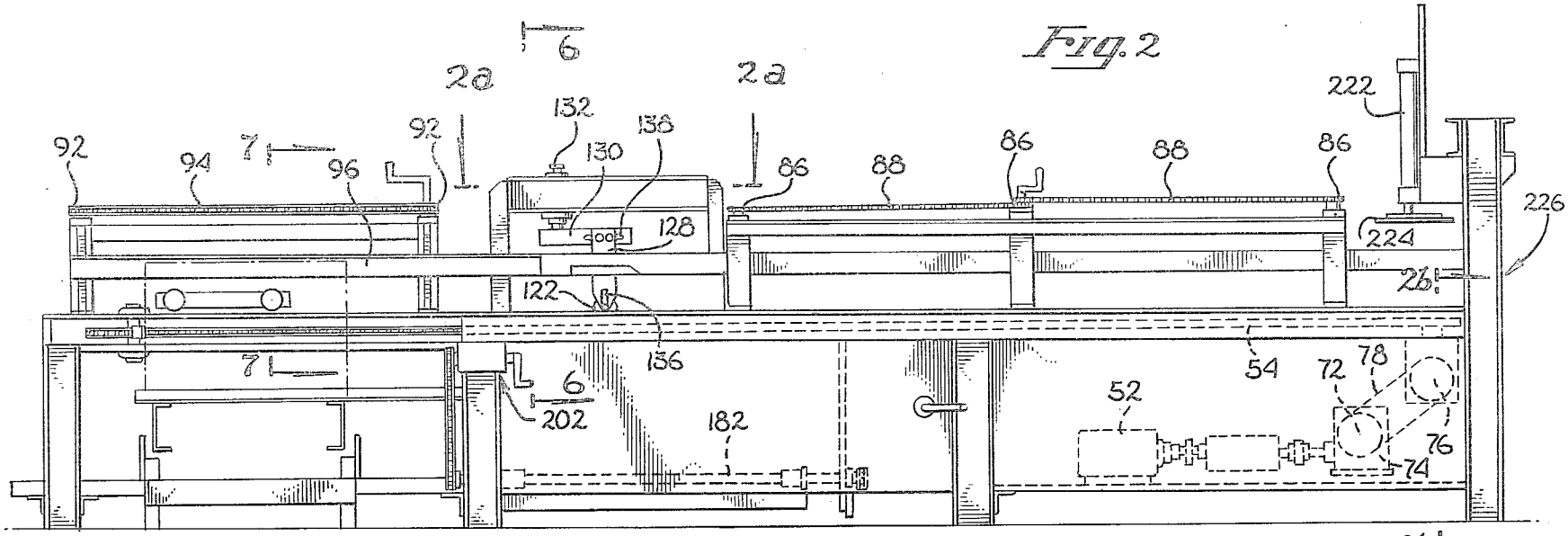
FIG. 2 is a side view of the preferred embodiment of FIG. 1 with the magazine removed.
Figure 2B:
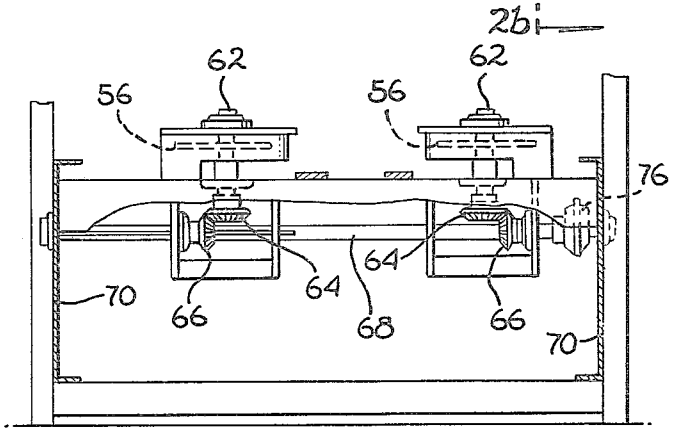
FIG. 2*b* is a partial cross-sectional view taken along lines 2*b*—2*b* of FIG. 2.

The main drive system through the erector may be seen in FIGS. 1, 2 and 2*b*. The drive in the preferred embodiment is provided by a 1½ horsepower motor 52 which drives a pair of chains 54 supported at one end on a pair of sprockets 56 and at the other end on sprockets 58 and 60. The sprockets 56 are supported on shafts 62, each of which is bearing supported on independent structure so that the relative separation between the two shafts may be adjusted. As shall subsequently be seen, this adjustment is used to adjust the erector for boxes of varying widths, as the desired separation of the adjacent lengths of chain 54 is approximately equal to the width of the boxes being erected. On the lower end of shafts 62 are conical gears 64, each of which mates with an adjacent gear 66, bearing supported on the same structure as the associated shaft 62. A transverse shaft 68, bearing supported on the side frame members 70, is keyed to the gears 66, thereby driving the gears in rotation while allowing the gears to slide longitudinally along the shaft as may be required during adjustment of the separation of the chains 54 (e.g., as determined by the separation between shafts 62). Shaft 68 is driven in rotation by the motor 52 through a gear reduction box 72 driving shaft 68 through the combination of sprockets 74 and 76 and drive chain 78.

The chains 54 each carry a plurality of equally spaced drive dogs 30, which as shall be seen advance the boxes through the various stations of the erector and deliver them at the output thereof. The boxes do not progress steadily through the preferred embodiment of the present invention, but stop at each station until the operation of that station is completed. Accordingly, in the drive train herein before described, there is also an electrically operated clutch and brake set so that the apparatus may be started and stopped quickly at each station. This is achieved by a switch which is activated by the passage of one of the drive dogs to stop the apparatus, with other switches at each station indicating the completion of the operation at that station so as to automatically start the drive mechanism again when each operation is complete. In that regard, the apparatus operates as a sequential machine, as is well known in the art, with the completion of various operations initiating the next operations.

Figure 6:
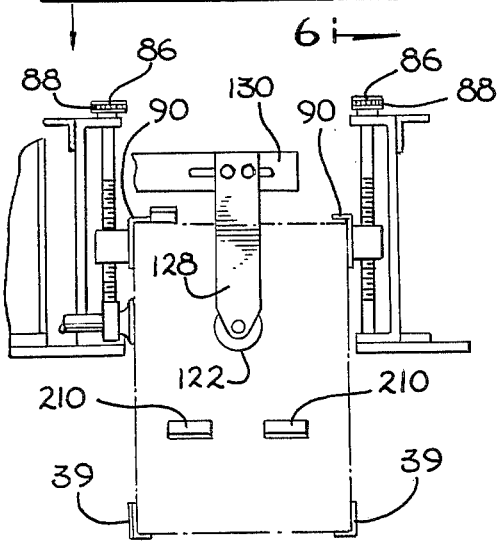
FIG. 6 is a partial cross-section taken along lines 6—6 of FIG. 2.
Figure 7:
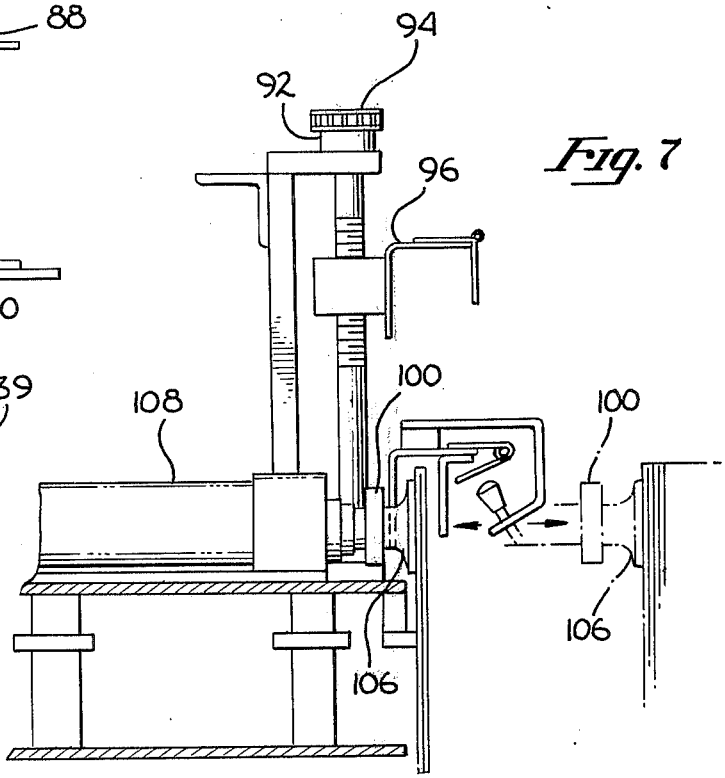
FIG. 7 is a partial cross-section taken along line 7—7 of FIG. 2.

As previously described, the magazine 20 maintains the next box to be erected adjacent the pullout station, and accordingly, this fixed position determines the desired position of one side of the erector apparatus, and thus the position of the longer drive chain 54 as shown in FIG. 1. The apparatus supporting the shorter drive chain is in turn supported on the screw shafts 80 coupled through a chain system 82 so as to be manually adjustable to hand crank 84. Thus by adjustment of the hand crank 84, relative separation between the two chain drives 54 may be adjusted as desired. Also visible in FIGS. 2, 6 and 7 are adjustments for the height of the box, and in particular the hold down channels which confine the box and prevent it from rising upward, particularly as the bottom longitudinal flaps are folded. These adjustments comprise lead screw assemblies 86 coupled through chains 88 so that rotation of any of the shafts of the lead screw assemblies will adjust the relative elevation of the hold down channels 90. Also, a second set of lead screw assemblies 92 coupled through chains 94 allows adjustment of the remainder of the hold down channel 96.

Now referring to FIGS. 1 and 1*a* (and incidentally to FIG. 2), the structure of the pull-out station will now be described. The vertical plate 100 is supported by a horizontal slide member 102 fitting within a horizontal slide 104 adjacent the face of the stack of boxes 22 in the magazine, with plate 100 supporting a pair of flexible vacuum cups 106 in a position facing the flat surface of the end box in the magazine. To remove an individual box from the magazine, an air operated piston cylinder assembly 108 is actuated, causing plate 100 to move outward to the position shown in phantom in FIG. 1*a* with the cups 106 coming against the side of the box to be next removed from the magazine. At the same time a vacuum is applied to cups 106 to provide a firm hold on that surface of the box as the piston cylinder assembly 108 is withdrawn. This causes the box to bow slightly and pull free of the magazine by passing between the two stops 26. When the box 22*a* is in the position shown in FIG. 1 the main drive system is engaged so that the drive dog 30 adjacent the box (specifically, drive dog 30*a*) encourages the box along the transport system toward the set-up station.

Figure 2A:
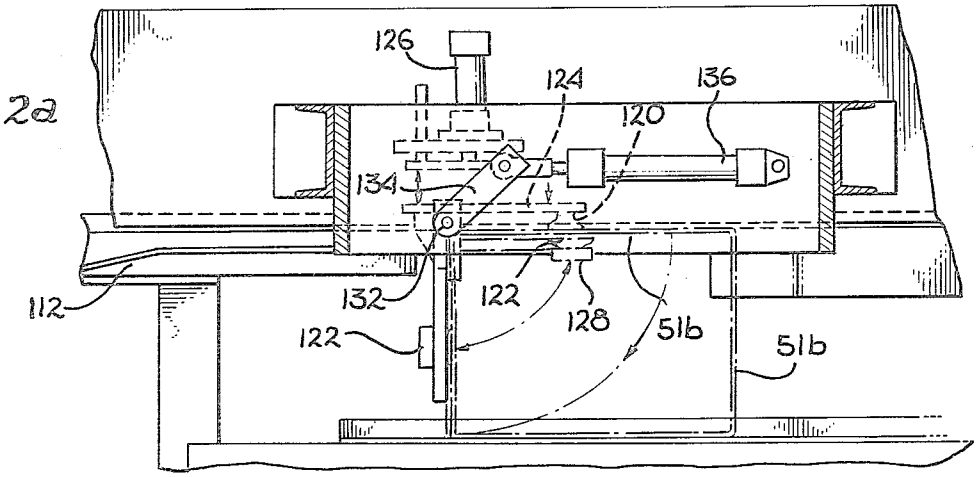
FIG. 2*a* is a top view of the set-up station taken along lines 2*a*—2*a* of FIG. 2.
Figure 5:
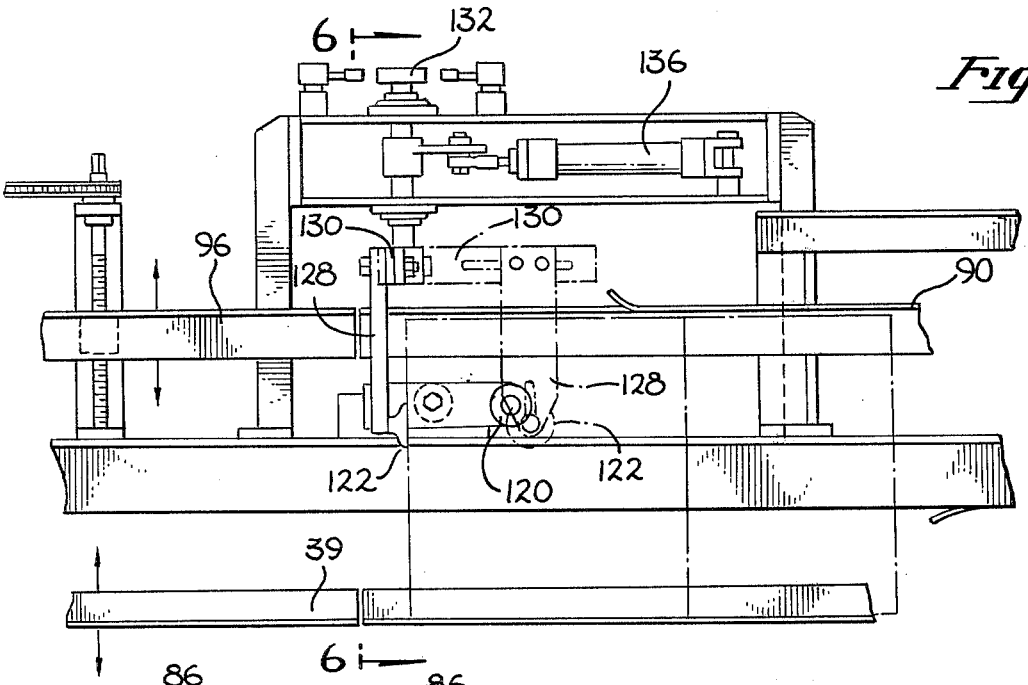
FIG. 5 is a side view of a section of the set-up station taken on an expanded scale along line 5—5 of FIG. 1.

Now referring to FIGS. 2, 2*a* and 5 (and incidentally to FIG. 1), certain of the details of the set-up station may be seen. The set-up station accomplishes two major functions in the erection of a box. First, the box is opened into its basically square or rectangular shape, and second, the bottom lateral flaps are folded. These two operations occur sequentially before the box is advanced past the glue station.

When the drive system stops with dog 30*a* in position to pick up the next box to be removed from the magazine at the pull-out station, dog 30*b* which has encouraged the last box from the pull-out station to the set-up station stops in the position shown in FIG. 1. This moves the box 51*b* to a position between two vacuum cups 120 and 122. The vacuum cup 120 is supported by a plate 124 which may be driven in a horizontal direction by a piston cylinder assembly 126. Vacuum cup 122 (see FIGS. 2 and 2*a*) is supported by a downward projecting arm 128 fastened to a lever 130, bearing supported on shaft 132. Shaft 132 in turn has a crank lever 134 coupled to a piston cylinder assembly 136. To provide a convenient adjustment for various size boxes, slot 136 is provided for an adjustment in the vertical position of vacuum cup 122, with the horizontal position being adjustable through the mounting slot 138.

The sequence of operations at the set-up station is initiated by the application of vacuum to vacuum cups 120 and 122, and at the same time, extending the piston cylinder assembly 126 so that vacuum cups 120 and 122 firmly grasp the respective sides of the folded box, with one fold therebetween. Then the piston cylinder assembly 136 is actuated (e.g., piston withdrawn to the position shown) which rotates the structure supporting vacuum cup 122 as shown in FIG. 2*a* to open the box 51*b* as shown. It will be noted that the axis of shaft 132 is basically collinear with the fold line on one corner of the box, and that vacuum cup 122 grasps the box on the panel which ultimately forms one end of the erected box.

Figures 8, 9, 10, 11, 12, 13:
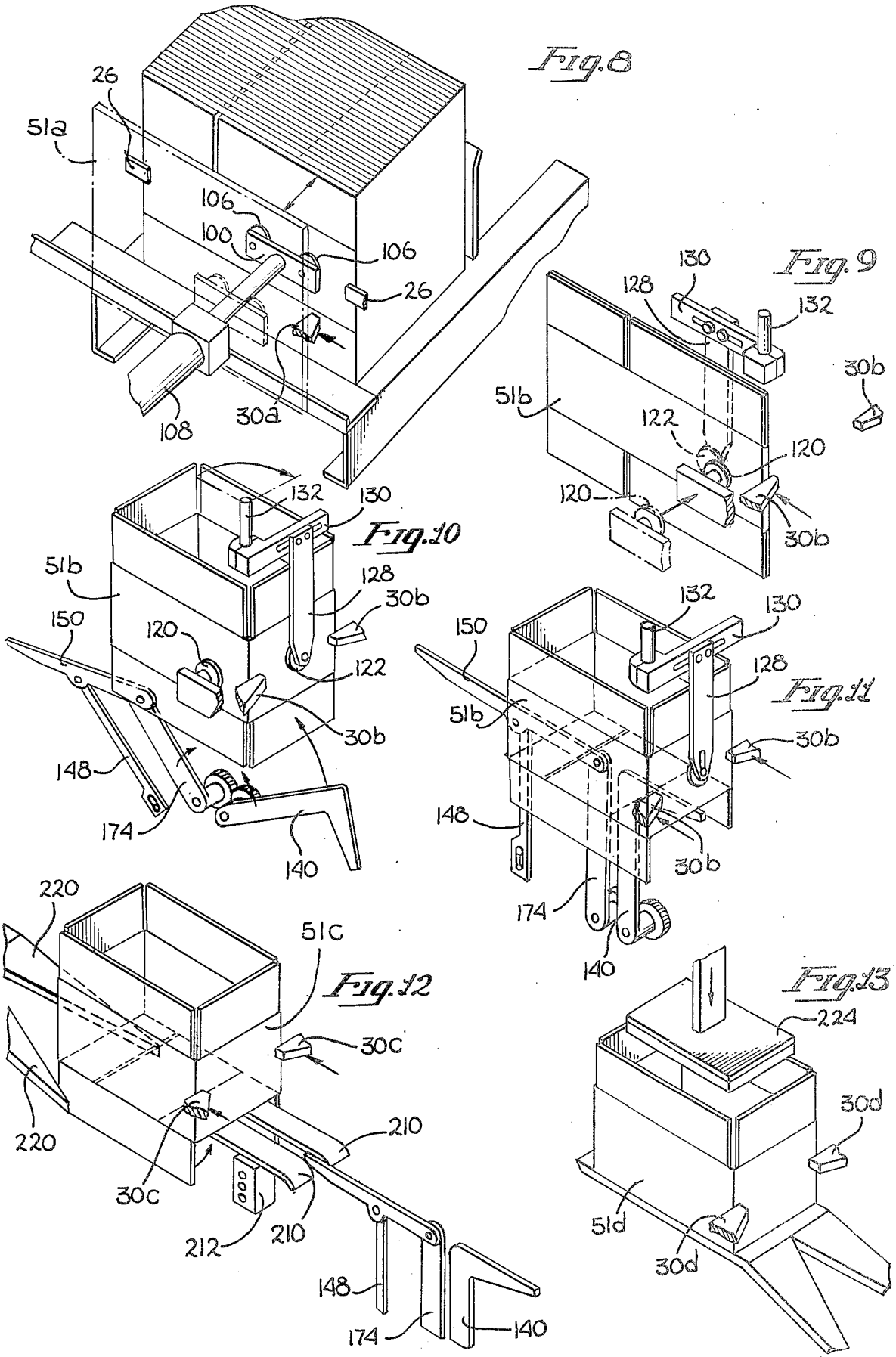
FIGS. 8 through 13 are schematic representations illustrating the various steps in the erection of the box as the box proceeds through the preferred embodiment of FIG. 1. (The various representations of these figures are taken as viewed in the general direction indicated by the numeral 250 in FIG. 1, as such views provide increased clarity in these figures, particularly with respect to FIG. 8 wherein the pull-out mechanism is schematically illustrated.)

The operation of the pull-out station and of the set-up station described thus far are schematically illustrated in FIGS. 8, 9 and 10. Thus, at the pull-out station piston cylinder assembly 108 thrusts vacuum cups 106 first inward against the stack of boxes 22 in the magazine, and then with vacuum applied to cups 106 outward to snap the box past the stops 26. At this point dog 30*a* picks up the box and advances the box along the path of travel in the machine, with the box being picked up by fixed guides for guidance to the set-up station. At the set-up station vacuum cup 120 is thrust against the side of the box so as to catch the box between vacuum cups 120 and 122, and with vacuum applied thereto, shaft 132 is rotated by the piston cylinder assembly 136 (FIG. 2*a*) to pull the box into the open position as shown in FIG. 10. In this position the second corner of the box is also picked up by a second dog 30*b* on the shorter chain 54 (FIG. 1).

Figure 3:
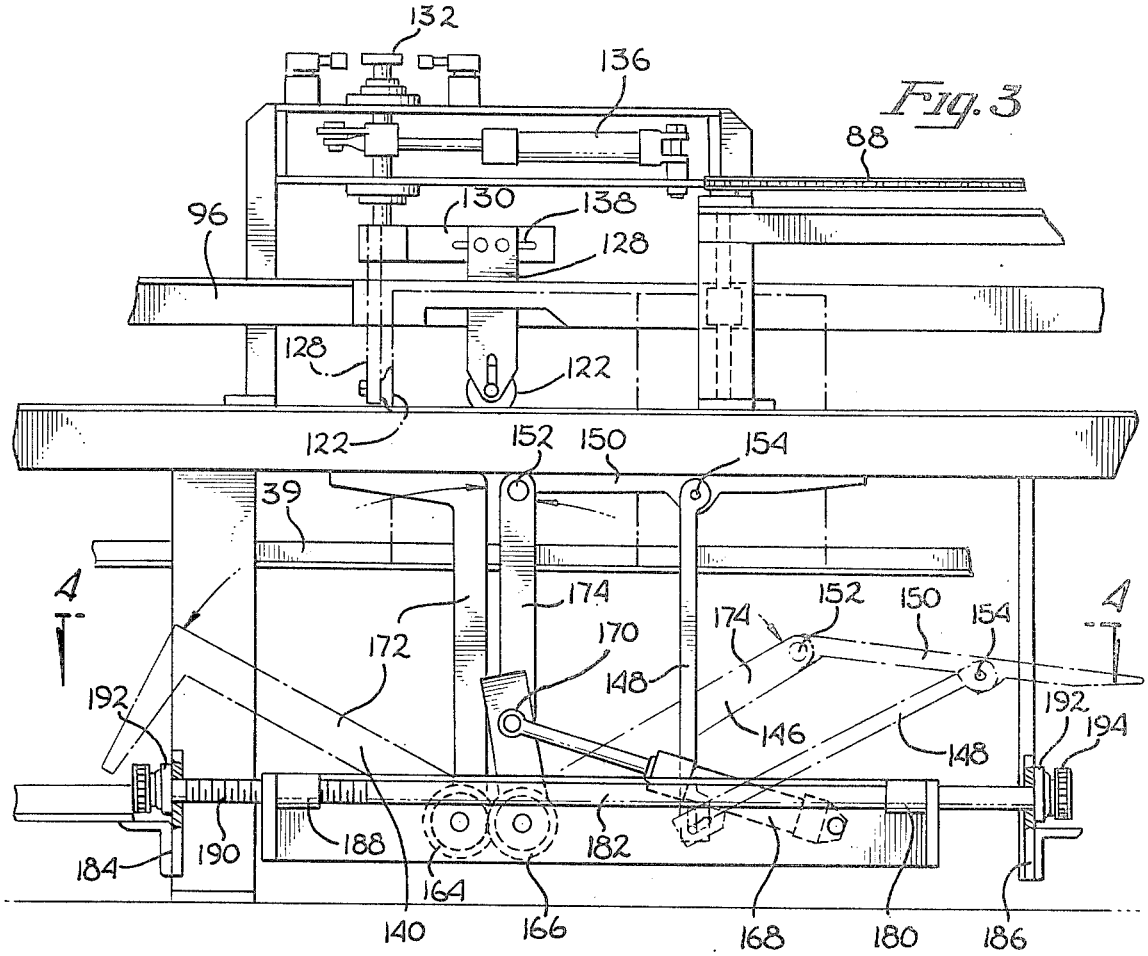
FIG. 3 is a side view of the lateral flap folding mechanism at the set-up station, taken along line 3—3 of FIG. 1.
Figure 4:
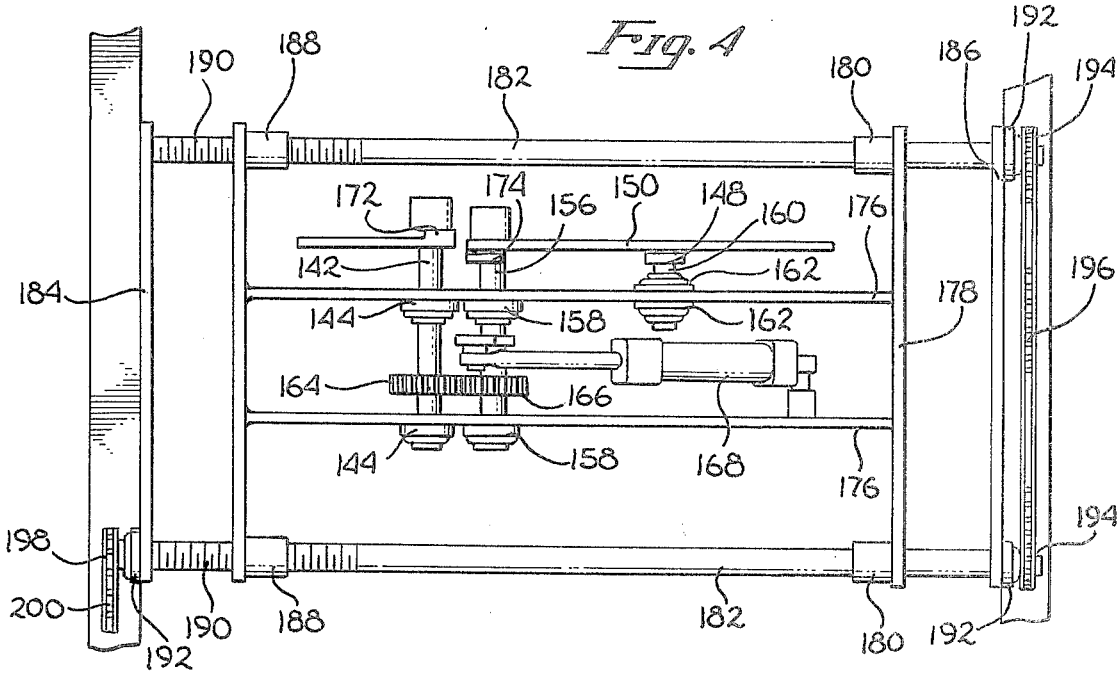
FIG. 4 is a top view of the lateral flap folding mechanism taken along line 4—4 of FIG. 3.

When the box is pulled to the open position a pair of scissors-like members, schematically shown in FIGS. 10 and 11, raise to the upper position to fold the lateral flaps. These scissors-like members, better shown in FIGS. 3 and 4, are comprised of a first member 140 supported on a shaft 142 and bearing set 144, and an assembly comprising member 146 and linkage 148 to support the longitudinal member 150. Member 146 and linkage 148 are pivotally fastened to member 150 by pins 152 and 154 respectively. Member 146 is fastened to shaft 156 supported by bearing set 158, and linkage 148 is supported on shaft 160, supported in turn by bearing set 162. Shafts 142 and 156 are coupled in rotation through gears 164 and 166, with shaft 156 being driven in rotation by a piston cylinder assembly 168 driving an actuating lever 170 fastened to shaft 156. Thus, by control of the piston cylinder assembly 168, member 140 and member 150 may be caused to raise and close, as illustrated in FIGS. 3, 10 and 11, to fold the end flaps. If desired, a protrusion may be placed in region 172 on member 140 and in region 174 on member 146 so as to catch the lower edge of the flap on the boxes being erected to initiate the folding thereof.

The best longitudinal position for the lateral flap folding mechanism will vary depending upon the size of the box being erected. Accordingly, in the present invention the entire assembly just described is supported by longitudinal structural members 176 which in turn are supported by a lateral member 178. One of the lateral members supports bushings 180 which freely slide on longitudinal shafts 182, with the shafts 182 being bearing supported at each end on the frame members 184 and 186 (see FIGS. 1, 3 and 4). Transverse member 178 is supported by lead screw followers 188 and a threaded portion 190 of the shafts 182, which in turn are bearing supported at the ends thereof by bearings 192. Thus, by simultaneous rotation of the shafts 182, the entire assembly may be shifted in a longitudinal direction as may be desired to provide an adjustment in the position of this lateral flap folding mechanism. To achieve this adjustment, the two shafts are locked in simultaneous rotation by the assembly comprising sprockets 194 and coupling chain 196, with the manual adjustment being achieved through sprocket 198, coupling chain 200 and sprocket shaft crank assembly 202 (see FIG. 1).

With the lateral flaps folded as shown in FIG. 11 (and at the same time the next box to be erected removed from the magazine ready for advancement to the set-up station) the drive system is again engaged and the box proceeds beyond the lateral flap folding mechanism, with the lateral flaps being held in the folded position by slide members 210. The box proceeds past a pair of adhesive applicators 212 (see FIG. 12) of conventional design supported between frame members 214 (FIG. 2), with a sensor not shown initiated by (the passage of the longitudinal flaps) turning on the adhesive applicators while the longitudinal flaps are interrupting the normal trajectory of the adhesive therefrom. Thereafter, the box 51*c*, encouraged by dogs 30*c*, approaches a pair of wedged shaped members 220 (FIGS. 1 and 12) which project downward and slightly to the sides of the longitudinal flaps so as to initially catch the lower edge of the flaps and encourage the flaps into the folded position as the box proceeds along its path of travel. The downward bend and the wedge shape of the members 220 is selected so as to catch the lower portion of the longitudinal flaps, regardless of the width of the box being erected, since in a conventional box the width of a flap in a vertical direction is slightly less than half the total width of the box itself.

When the box being erected reaches the press-station on the encouragement of dogs 30*d* (FIGS. 1, 2 and 13) a piston cylinder assembly 222 is activated, thrusting a pressure plate 224 into the open top of the box 51*d* for passing the lateral flaps against the adhesive coated surface of longitudinal flaps, assuring ample opportunity for the adhesive to secure the flaps to complete the erection of a box. Of course, on the next advancement of the transport system, the erected box is delivered to the exit of the erector, generally indicated by the numerals 226 in FIGS. 1 and 2.

There has been described herein an improved box erector which may be used for the rapid erection of cardboard boxes of varying sizes. The erector of the preferred embodiment is generally operated through an air system, that is, the operation of a plurality of air operated piston cylinder assemblies and control valves for controlling the sequencing of the machine. The control system used in the preferred embodiment is a simple sequential control system, with the completion of each phase of each operation initiating the next phase, and with the completion of each complete operation at all stations initiating the transport system to advance the boxes to the next station. In that regard the transport system is of intermittent operation, and in the preferred embodiment sensors are provided to sense not only the completion of the operation of the apparatus at each station, but further to sense the presence of a box in accordance with the operation to be completed at that location. By way of specific example, at the pull-out station a sensor is provided which senses the disposition of a folded box in proper position on the transport system before the transport system, e.g., drive system, is initiated. Accordingly, if the magazine is for some reason inoperative or is exhausted of folded boxes, the operating cycle at the pull-out station will continuously repeat itself without further advancement of the drive system.

The advantages of the present invention over the prior art are numerous. In particular, the stationized erection of boxes as opposed to the complete erection of a box at one location grossly reduces the number of operations which must be completed before the erection of the next box is initiated. Accordingly, throughput on the machine of the present invention is substantially higher than the throughput of prior art machines even without increasing the basic speed of operation of the apparatus thereof. Furthermore, while adjustments in the prior art apparatus to accommodate boxes of varying sizes is known, such adjustments do not include an adjustment in the lateral flap folding mechanism so as to provide the full degree of adjustment of the present invention.

While the preferred embodiment of the present invention has been disclosed and described herein, various changes may readily be made therein. By way of example, the system may be operated by an air pressure system, or a hydraulic system, if desired. Further, the forward lateral flap may be folded by a fixed member intercepting the longitudinal progression of the lateral flap in the path of travel of the transport system rather than using a mechanism projecting upward to intercept the flap at the set-up station. Thus, while the preferred embodiment has been disclosed and described in detail herein, it will be obvious to those skilled in the art that various changes in form and detail may be made therein without departing from the spirit and scope of the invention.

We claim:

1. A case erector comprising:

a transport means for transporting boxes through said case erector;

a magazine means for holding a plurality of folded boxes;

a pull-out station means for sequentially removing individual folded boxes from said magazine means and disposing said boxes so as to be received by said transport means;

a set-up station means for sequentially receiving folded boxes from said transport means and opening said boxes;

first folding means, located at said set-up station, for folding the lateral flaps on the bottom of each box, said first folding means comprising (a) first and second members, (b) actuating means for moving each of said first and second members from a first lower position through a path of travel generally upward and toward each other to intercept and fold the lateral flaps on a box, (c) support means coupled to said first and second members, and (d) adjustment means for adjusting the position of said support means in accordance with the characteristics of the boxes being erected wherein said adjustment means comprises at least one lead screw, said support means having at least one lead screw follower cooperatively disposed with respect to said lead screw whereby said support means is positioned by the rotation of said lead screw;

application means for applying adhesive to at least one flat of each box as said boxes are advanced by said transport means;

second folding means for encouraging the longitudinal flaps of each box into the folded position as each box is advanced by said transport means; and a press-station means for pressing the folded lateral and longitudinal flaps into firm face to face abutment to secure good adhesion of said flaps.

2. The case erector of claim 1 wherein said support means comprises a frame assembly and support for said activating means, said adjustment means comprises a pair of lead screws rotationally supported on parallel axes from said frame structure, and means for adjustably rotating said lead screws in unison, said frame assembly being supported on said lead screws and having at least one lead screw follower engaging each lead screw.

* * * * *